US008333262B1

(12) United States Patent
Carpenter et al.

(10) Patent No.: US 8,333,262 B1
(45) Date of Patent: Dec. 18, 2012

(54) RECONFIGURABLE, MODULAR ERGONOMIC SIT HARNESS OR SADDLE

(75) Inventors: Amanda Carpenter, Warrensburg, NY (US); Edgar P. Carpenter, Milford, MA (US); Christopher A. de la Vera, Windsor, NY (US); Scott Hall, Binghamton, NY (US); James J. Rullo, Binghamton, NY (US)

(73) Assignee: Buckingham Manufacturing Company, Inc., Binghamton, NY (US)

( * ) Notice: Subject to any disclaimer, the term of this patent is extended or adjusted under 35 U.S.C. 154(b) by 0 days.

(21) Appl. No.: 12/617,102

(22) Filed: Nov. 12, 2009

Related U.S. Application Data

(60) Provisional application No. 61/113,725, filed on Nov. 12, 2008.

(51) Int. Cl.
*A62B 35/00* (2006.01)

(52) U.S. Cl. ..... 182/6

(58) Field of Classification Search ..... 182/3, 6, 182/7

See application file for complete search history.

(56) References Cited

U.S. PATENT DOCUMENTS

| | | | | | |
|---|---|---|---|---|---|
| 910,006 | A * | 1/1909 | Lowy | 182/7 |
| 1,636,459 | A * | 7/1927 | Chappel | 182/3 |
| 2,887,286 | A * | 5/1959 | Moran | 244/143 |
| 2,979,028 | A * | 4/1961 | Zakely | 182/3 |
| 3,757,893 | A * | 9/1973 | Hobbs | 182/6 |
| 4,687,074 | A * | 8/1987 | Green | 182/3 |
| 4,928,789 | A * | 5/1990 | Claeys | 182/3 |
| 5,228,609 | A * | 7/1993 | Gregory | 224/617 |
| 5,398,667 | A * | 3/1995 | Witt | 126/263.01 |
| 5,413,262 | A * | 5/1995 | Dewire et al. | 224/675 |
| 6,431,313 | B1 * | 8/2002 | Petzl et al. | 182/6 |
| D490,938 | S * | 6/2004 | Wydner | D29/101.1 |
| 6,766,532 | B1 * | 7/2004 | Cabana | 2/44 |
| 7,575,136 | B2 * | 8/2009 | Kernkamp | 224/159 |

FOREIGN PATENT DOCUMENTS

| | | | |
|---|---|---|---|
| EP | 1712259 | A2 * | 10/2006 |
| FR | 2606650 | A1 * | 5/1988 |
| FR | 2649618 | A1 * | 1/1991 |
| GB | 2431563 | A * | 5/2007 |

* cited by examiner

*Primary Examiner* — Alvin Chin Shue
(74) *Attorney, Agent, or Firm* — Mark Levy; David L. Banner; Hinman, Howard & Kattell, LLP

(57) ABSTRACT

A reconfigurable, modular ergonomic sit harness or saddle for use by linesmen, arborists, or the like includes a gender-specific back pad assembly that supports a number of removable, optional attachments allowing customization for user preference or job environment. Gender-specific angled wing portions of the back pad contain an armor layer and extra padding to protect the bony protrusions of both the male and female pelvis. A "one size fits all" approach includes a waistband having length adjustability over approximately a 3:1 range. Each component and sub-system of the sit harness is ergonomically designed to maximize comfort and minimize stresses on a user's body. The back pad features interchangeable lumbar support pads. Optional, removable features include a seat, an abdominal support, and a body harness for use with a fall restraint device. Interchangeable suspension bridges allow user attachment to a wide range of support systems.

15 Claims, 15 Drawing Sheets

RECONFIGURABLE, MODULAR ERGONOMIC SIT HARNESS OR SADDLE

RELATED APPLICATIONS

This application is a Continuation-in-Part of U.S. Provisional Patent Application Ser. No. 61/113,725 filed Nov. 12, 2008 and claims priority thereto in accordance with 35 U.S.C. §1.78.

FIELD OF THE INVENTION

The invention pertains to safety equipment for climbers such as linesmen, arborists and the like and, more particularly, to a reconfigurable, modular sit harness having multiple ergonomically designed selectable components for supporting a worker in an elevated and/or suspended position.

BACKGROUND OF THE INVENTION

Large numbers of workmen must perform their work tasks above the ground. A growing awareness of worker safety along with ever-increasing governmental and insurance workplace safety requirements has resulted in the design and development of many types of new and improved safety equipment for such workers. Workers (e.g., arborists) must perform at least some aerial work while suspended. To accomplish such tasks, safety harnesses, specifically "sit harnesses" (i.e., saddles) have been developed.

In its simplest form, a sit harness or saddle consists of a pair of leg supports (e.g., leg loops) joined to a belt by a link to a body belt, and at least one suspension point for attaching a wearer to a support system. A mechanism may be included for positioning the leg loops with respect to the belt according to the distance between the user's crotch and waist.

In more advanced implementations, sit harnesses may also include a seat structure for supporting the user's buttocks, thereby relieving some pressure from the wearer's legs. However, sit harnesses of the prior art, especially when worn for extended periods of time, may impose stress on the body of the wearer.

Sit harnesses and other such safety devices of the prior art are generally neither reconfigurable (i.e., modular) nor adjustable across a wide range of sizes. Also, many desirable or undesirable features may be permanently installed. Additionally, structural components of sit harnesses of the prior art are generally permanently connected. Consequently, damage to one portion or component of the sit harness necessitates the replacement of the entire harness.

DISCUSSION OF THE RELATED ART

Sit harnesses are known to those of skill in the aerial workplace safety arts. For example, U.S. Pat. No. 6,050,364 for SIT HARNESS OR ROPING HARNESS ADJUSTABLE IN HEIGHT, issued Apr. 18, 2000 to Peter Popall, et al. discloses a sit harness having a pair of leg loops joined to a belt by means of a link of webbing passing through a securing ring. The securing ring includes an adjustment mechanism for the height-wise positioning of the link webbing to adjust the leg loop module with respect to the belt according to the distance between the user's crotch and waist. The adjustment mechanism is formed by at least one intermediate strand subdividing the inside of the ring into super-posed orifices arranged at different positioning levels.

Neither this patent nor any other known prior art reference, taken singly, or in any combination is seen to teach or suggest the novel ergonomic sit harness of the present invention.

It would, therefore, be desirable to provide a sit harness that is ergonomically designed to be both comfortable to wear for extended periods of time and also safe to prevent injury to the body of a wearer.

It would further be desirable to provide a sit harness having modular, ergonomic construction that allows a wide range of features to be added to or removed from the basic sit harness to meet the needs and preferences of a wide range of possible users and work applications.

It would also be desirable to provide a sit harness wherein individual structural components are replaceable to allow relatively inexpensive repair of the harness in the event of damage to or excessive wear of one of the components thereof.

SUMMARY OF THE INVENTION

In accordance with the present invention there is provided a reconfigurable, modular ergonomic sit harness or saddle for use by linesmen, arborists, or other workmen who must work in elevated and, more specifically, suspended positions. The novel sit harness or saddle embodies many features that allow it to be adapted to the specific needs of individual users. The novel back pad provides length adjustability over approximately a 3:1 range that allows a particular size back pad to fit a wide range of waist sizes, thus eliminating the need to provide numerous sizes of back pad, and allowing a number of users to share a single sit harness.

Importantly, each component and sub-system of the novel sit harness is designed in accordance with ergonomic principles to maximize size while minimizing stresses on the bodies of users. This resulting reduction in body stresses accounts for the improvement in comfort of the inventive sit harness system over sit harnesses of the prior art. For example, the back pad and the reconfigurable lumbar support system are gender specific to ensure maximum protection and comfort depending upon the body structure of the wearer.

Because of its modular construction, the novel harness may be reconfigured for use with different climbing styles and systems, such as the single rope technique currently gaining in popularity. Features such as an abdominal support, a batten seat, interchangeable suspension systems, and a full body harness may be added to or removed from the basic sit harness in accordance with the preference of an individual user or as dictated by the type of elevated work being performed.

Of special importance is the fact that the load bearing webbing is separable from the back pad allowing independent replacement of either component as required when one or the other is damaged or becomes excessively worn.

It is, therefore, an object of the invention to provide a sit harness or saddle assembly in which each component and sub-system is ergonomically designed to minimize stress on the body during use.

It is another object of the invention to provide a sit harness or saddle assembly that is reconfigurable to allow addition and removal of components and/or features to accommodate individual wearer preferences and to adapt the sit harness for performance of a wide range of aerial tasks.

It is a further object of the invention to provide a sit harness or saddle assembly in which load bearing webbing is detachable from the back pad to allow selective replacement of either component.

It is an additional object of the invention to provide a sit harness or saddle assembly in which novel adjustability features allow a small number of belt components to accommodate a wide range of wearer sizes.

It is a further object of the invention to provide a sit harness or saddle assembly having a predetermined range of waist tensioning adjustability.

It is another object of the invention to provide a sit harness or saddle assembly having a range of waist tensioning adjustability in a range of approximately 3:1.

It is a still further object of the invention to provide a sit harness or saddle assembly in which work-positioning D-rings may be adjusted for individual wearer preference.

It is yet another object of the invention to provide a sit harness or saddle assembly that incorporates a gender-specific back pad.

It is a further object of the invention to provide a sit harness or saddle assembly in which interchangeable suspension connections are provided to accommodate multiple tie-in options for different climbing styles.

It is an additional object of the invention to provide a sit harness or saddle assembly allowing attachment of a body harness and related fall protection safety equipment.

It is yet another object of the invention to provide a sit harness or saddle assembly having a selectively removable seat assembly.

It is a still further object of the invention to provide a sit harness or saddle assembly having a selectively removable abdominal support or stabilization system.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

Note that the orientations front, rear, top, and bottom are with respect to a particular component's orientation when in place on a wearer's body.

DETAILED DESCRIPTION OF THE PREFERRED EMBODIMENT

The present invention provides an ergonomic, reconfigurable, modular sit harness or saddle assembly for use by workers in aerial work environments.

Figure 1:
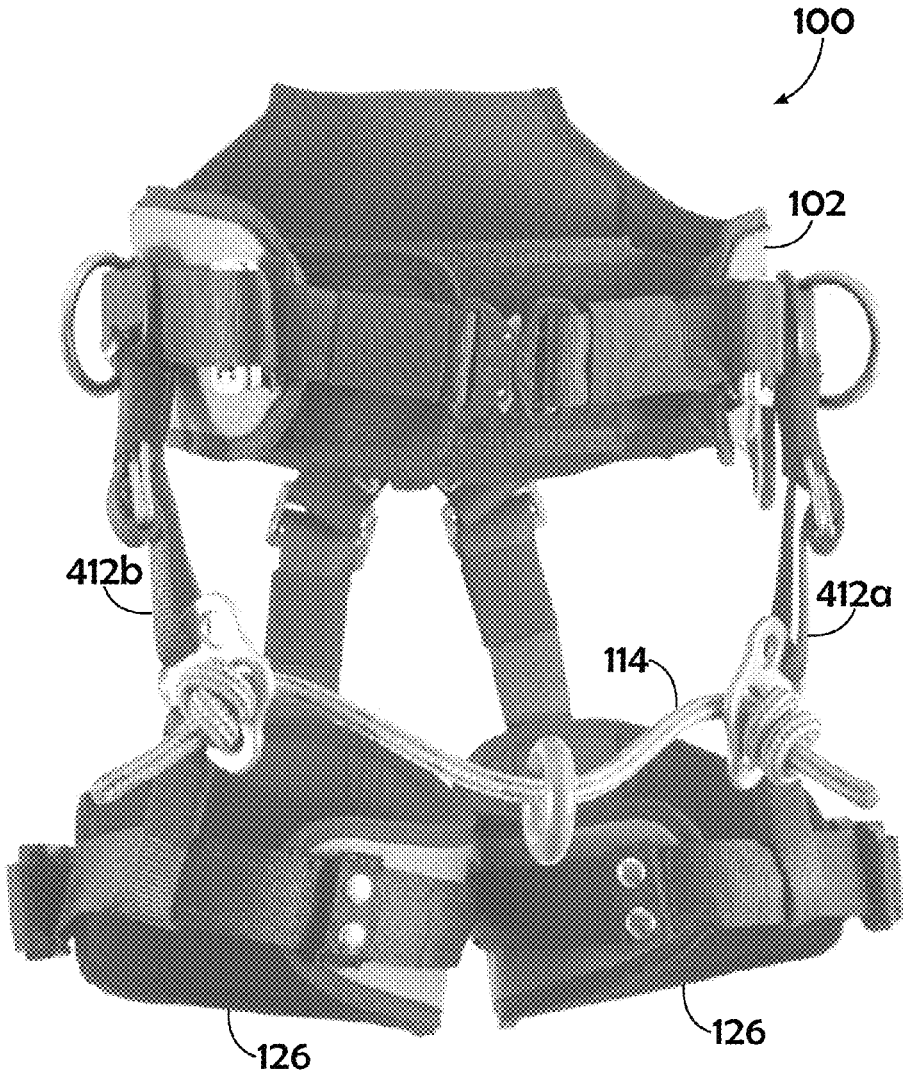
FIG. 1 is a perspective, schematic view of the ergonomic, reconfigurable, modular sit harness assembly in accordance with the invention.

Referring first to FIG. 1, there is shown a perspective, schematic view of the ergonomic, reconfigurable, modular sit harness assembly in accordance with the invention, generally at reference number 100. A back pad assembly 102 supports lower leg strap assemblies 126 and a replaceable suspension bridge assembly 114. The components of back pad assembly 102, lower leg strap assemblies 126, and suspension assembly 114 are described in detail hereinbelow.

Figure 2:
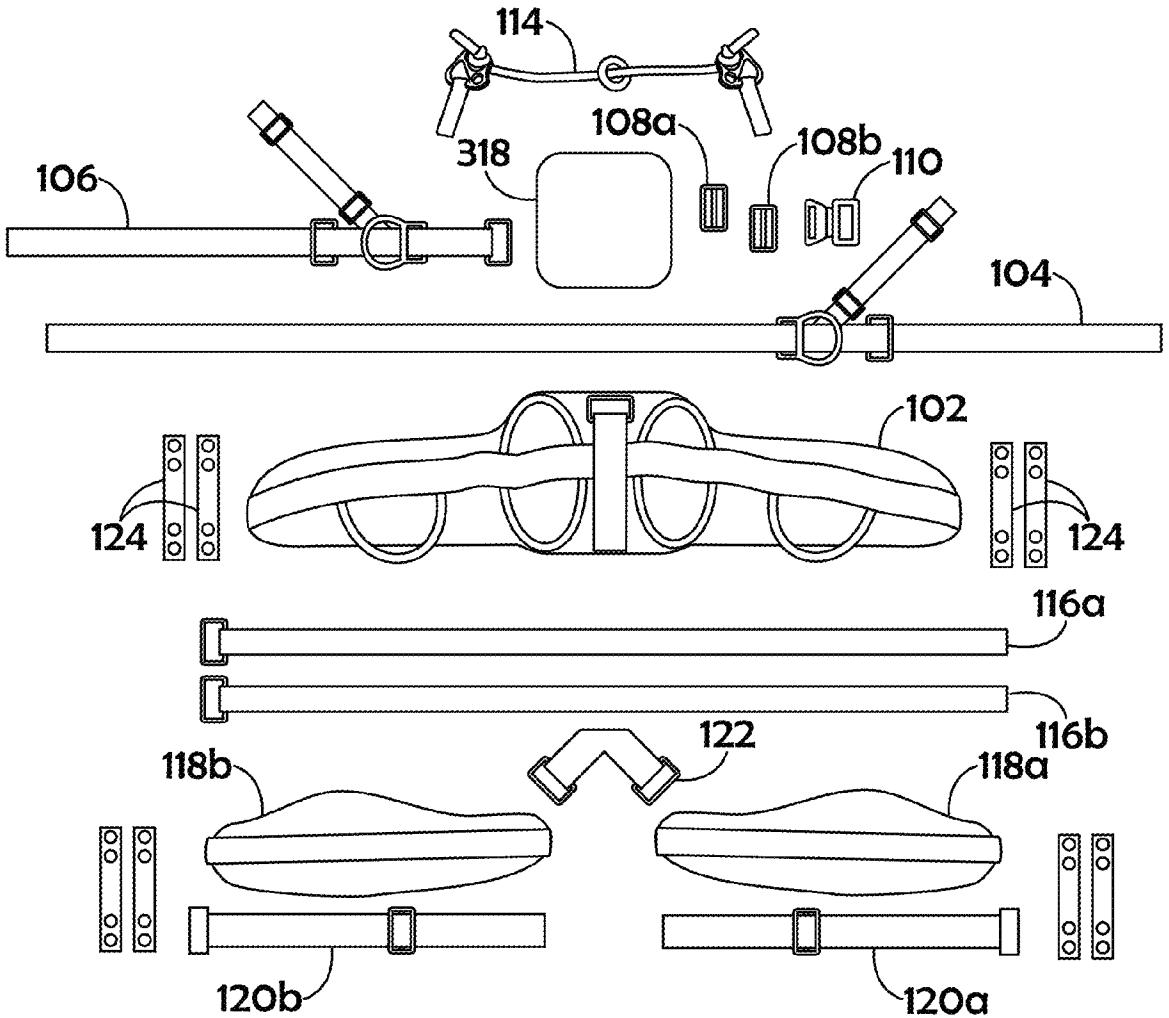
FIG. 2 is a top plan view of the components of the sit harness assembly of FIG. 1.

Referring now to FIG. 2, there is shown a top plan view of some of the components used to assemble a basic sit harness or saddle assembly 100.

The fundamental components of sit harness 100 include back pad 102, long D-piece assembly with suspension 104, short D-piece assembly with suspension 106, waist adjustment buckles 108*a*, 108*b*, quick-connect waist buckle 110, interchangeable lumbar support 318, suspension bridge assembly 114, leg straps 116*a*, 116*b*, leg pads 118*a*, 118*b*, leg strap retainers 120*a*, 120*b*, leg strap retaining anchor 122, and snap webbing keepers 124.

Figure 3A:
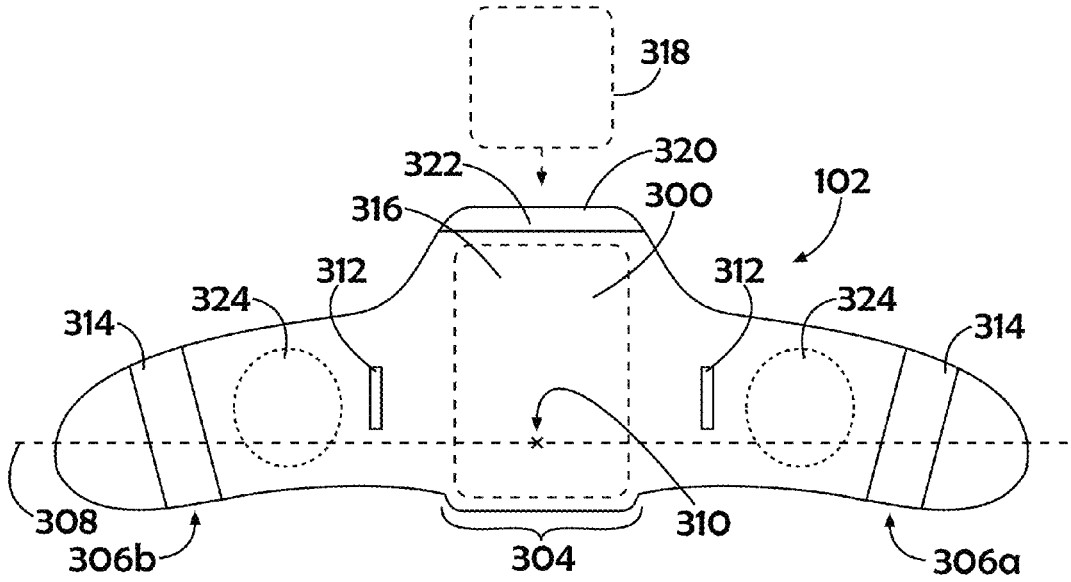
FIGS. 3*a* and 3*b* are front and rear elevational views, respectively, of a back pad assembly.
Figure 3B:
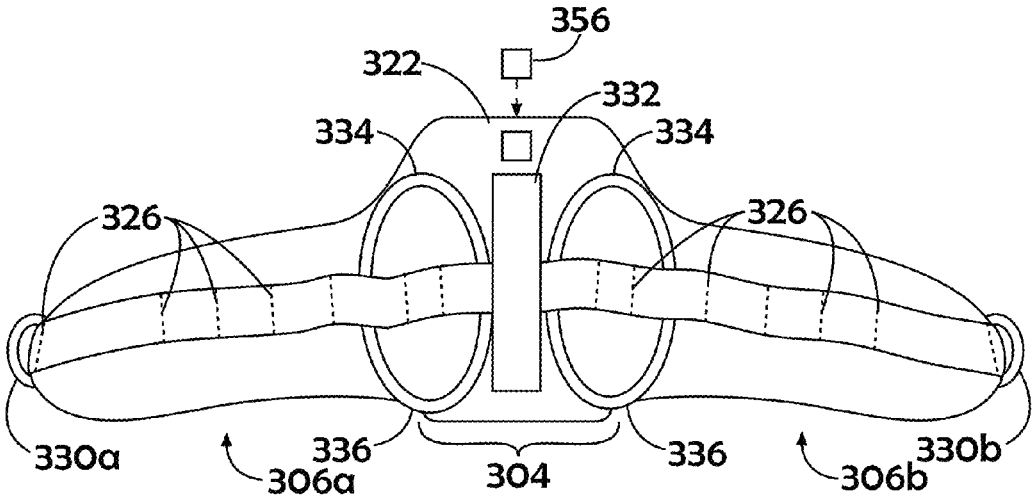

Referring now to FIGS. 3*a* and 3*b*, there are shown front and rear elevational views, respectively, of back pad 102. Back pad 102 has a front (i.e., inside), body-facing surface 300 and a rear (i.e., outside) surface 302. Back pad 102 is divided into a central lumbar portion 304 and two angled wings 306*a*, 306*b* at either side of central lumbar portion 304. A central point 310 along a major axis 308 of back pad 102 indicates the region of central lumbar portion 304 designed for positioning proximate the wearer's spine, not shown, in the lumbar region of a wearer's back, not shown.

Angled wings 306*a*, 306*b* are provided at each side of central lumbar portion 304 such that back pad 102 may encircle the pelvic girdle, not shown, of a wearer. Back pad 102 has a specific, gender-determined overall shape or contour, at least one contour being provided for males and at least a second contour being provided for females. A "male" contour is shown herein for purposes of disclosure. However, as FIGS. 3*a* and 3*b* are considered schematic, they are intended to represent both a male contour and a female contour.

Angled wings 306*a*, 306*b* slope downward and cover the pelvic bony protrusions. When wrapped around the pelvis of a wearer, angle wings 306*a*, 306*b* are contoured to the pelvis.

Slots 312 are provided to allow attachment of an optional abdominal stabilizer 900 (FIG. 8) described in detail hereinbelow. Loops 314 are also used in conjunction with abdominal stabilizer 900.

A lumbar pocket 316 is provided to receive one or more interchangeable lumbar support pads 318 which may be inserted into lumbar pocket 316 from a top opening 320. A closure flap 322 secures interchangeable lumbar support pad 318 within lumbar pocket 316. Lumbar pocket 316 is typically closed along its bottom edge.

The specific lumbar support provided by back pad 102 may be controlled for the individual comfort of a wearer. Gender-specific lumbar support pads 318 may be provided to properly support the lumbar region of male and female wearers. In addition to interchangeable lumbar support pads 318, hot or cold packs, not shown, or any other suitable objects may be contained in lumbar pocket 316. The term interchangeable lumbar support pad as used herein is intended to include lumbar pads, hot or cold packs, other therapeutic devices or other suitable objects.

One type of lumbar support pad adaptable for use within pocket 316 is a fluid-filled lumbar support pad. The fluids may include water or another liquid media or air. An air-filled lumbar support pad may include a valve mechanism adapted to receive and/or discharge air from an interior region of the air filled lumbar support pad, In other embodiments of an air filled lumbar support pad, a pump may be permanently or removably attached to the valve mechanism. The pump may be a simple, hand-operated pump, for example, a resilient bulb. In still other embodiments, the pump may be a small, electrically driven pump. Such pumps are believed to be well known to those of skill in the art and are not further described herein.

It will be recognized that lumbar support 316 may be adapted for use on any elongated, torso-encircling member, not shown. Such torso-encircling members are well known to those of skill in the art and may include, but not be limited to body belts, harnesses, etc. Pocket 316 may be either permanently or removably attached thereto. Typically, pocket 316 is selectively positioned along a major axis of a torso-encircling member so as to be placed in contact with the limbar region of a wearer of the torso-encircling member.

While back pad 102 contains a nominal amount of padding 342 (FIGS. 3*c* and 3*d*), additional padding 324 (FIG. 3*d*) covers at least a portion of angled wings 306*a*, 306*b*.

Horizontal webbing 328 is secured to the rear (outside) surface 302 of back pad 102, typically by vertical stitching 326. Gaps between vertical stitching 326 define loops in horizontal webbing 328. Such loops are useful for attaching modular components or features described in detail hereinbelow.

Loops 330 are attached to horizontal webbing 328 proximate each end thereof.

A central tailpiece 332 is attached to back pad 102 and horizontal webbing 328, positioned at approximately a central point 310. Tailpiece 332 is stitched to back pad 102 and horizontal webbing 328 at its upper end. The middle and lower portions of tailpiece 332 are attached to back pad 102 by hook-and-loop fastener material, not specifically identified. Tailpiece 332 provides at least one loop through which additional horizontal members (described in detail hereinbelow) may be passed.

Gear loops 354 and 356, typically formed from folded nylon webbing, are secured to horizontal webbing 328. Gear loops 354 are affixed to back pad 102 at an upper edge of horizontal webbing 328. Gear loops 356 are affixed to back pad 102 at a lower edge of horizontal webbing 328.

Figure 3D:
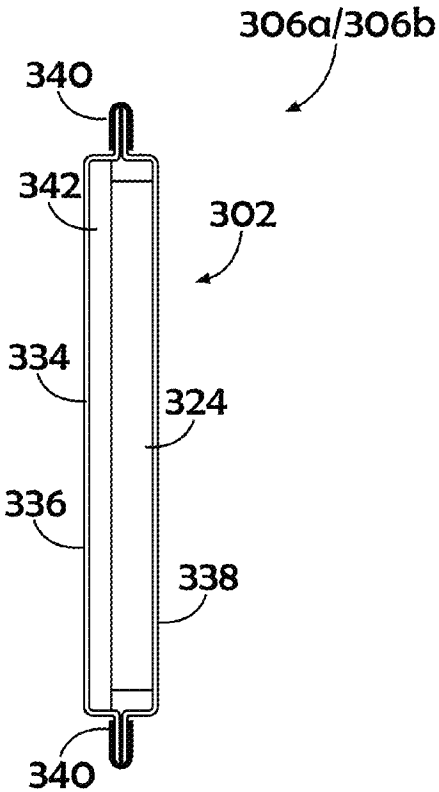
FIGS. 3*c* and 3*d* are cross-sectionals views of a central lumbar portion and an angled wing portion, respectively, of the back pad of FIGS. 3*a* and 3*b;*
Figure 3C:
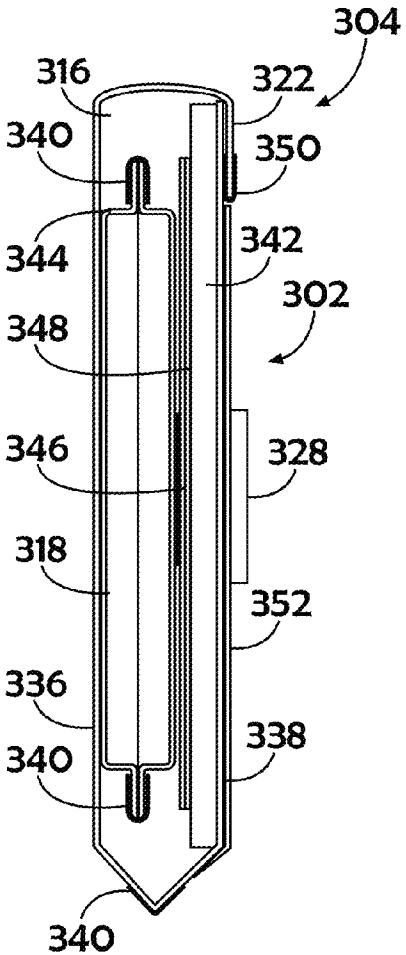

Referring now also to FIGS. 3*c* and 3*d*, there are shown schematic, cross-sectional views of central lumbar portion 304 and an angled wing 306*a*, 306*b*, respectively, of the back pad 102 of FIGS. 3*a* and 3*b*.

As may be seen in FIG. 3*c*, central lumbar has an inner fabric layer 336, typically formed from two layers of a material such as Dri-Lex® material. Dri-Lex is a registered trademark of the Faytex Corp. of Weymouth, Mass.

Inner fabric layer 336 forms one side of lumbar pad pocket 316. An interchangeable lumbar support pad 318 is shown positioned in lumbar pocket 316. Interchangeable lumbar support pad 318 is typically formed from two layers of a material such as Dri-Lex® with a foam filler 318. Webbing or binding 340 is used to secure the front and rear layers of fabric 344 forming interchangeable lumbar support pad 318. Typically, webbing 340 is an approximately 1-inch strip of herringbone nylon webbing. It will be recognized that other suitable materials, patterns, and/or dimensions may be chosen rather than the 1-inch nylon chosen for purposes of disclosure.

Mating hook-and-loop material 346 may be used to secure interchangeable lumbar support pad 318 in lumbar pocket 316. A flap 322 with hook-and-loop material 350 is used to secure interchangeable lumbar support pad 318 in lumbar pocket 316.

A polyethylene sheet 348 is disposed in lumbar pocket 316 to add stiffness. Foam padding or filler 342 is placed adjacent polyethylene sheet 348 and an outer fabric layer 338, typically Cordura® fabric or a similar fabric, completes back pad 102. Cordura® is a registered trademark of INVISTA of Wichita, Kans. for durable fabrics. A 1000 denier cover material has been found suitable for the application. Other similar fabrics believed known to those of skill in the art may be substituted for the Cordura® fabric chosen for purposes of disclosure.

As may be seen in FIG. 3*d*, the angled wing portions 306*a*, 306*b* of back pad 102 have an inner fabric layer 336, typically formed from Dri-Lex® fabric and a foam pad or filler 342. A high-density polyethylene "armor" layer 334 is disposed adjacent padding 342. A thick outer pad 324 is positioned adjacent high-density polyethylene armor layer 334. Finally an outer fabric layer 338 completes angled wing portions 306*a*, 306*b*. Outer fabric 338 is typically 1000 denier Cordura® fabric.

Webbing 340 joins and secures the edges of angled wing regions 306*a*, 306*b*.

High-density polyethylene armor layer 334 and thick outer pad 324 serve to protect the bony protrusions of the pelvis of a wearer of sit harness 100 by buffering and laterally distributing any force applied to that region of the body. Such force may be a continuous force applied by safety equipment or may be impact force from an environmental object. While high-density polyethylene armor layer 334 is shown only in angled wings 306*a*, 306*b* for purposes of disclosure, it will be recognized that high-density polyethylene armor layer 334 may be provided in other regions of back pad 102 as well. High-density polyethylene armor layer 334 may be formed from a polymer, a metal, or any other material that may serve to protect the pelvic bony protrusions or other body portion encircled by back pad 102.

Horizontal webbing 328 is attached to outer fabric layer 338. It will be recognized that other webbing, hook-and-loop material, webbing loops, etc., shown schematically at reference number 352, may also be attached to back pad 102, typically on outer surface 302.

Figure 4A:
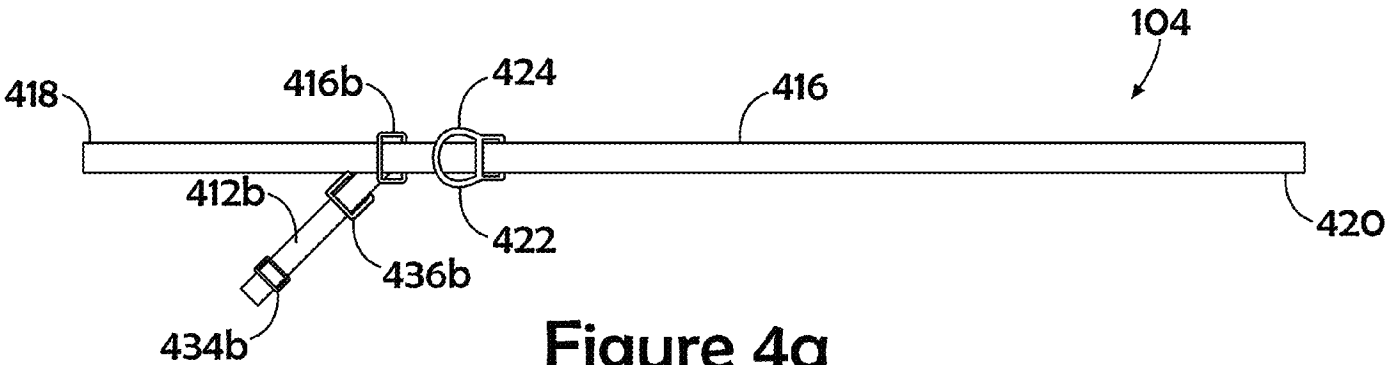
FIGS. 4*a* and 4*b* are top plan views of a long D-piece assembly and short D-piece assembly, respectively.
Figure 4B:
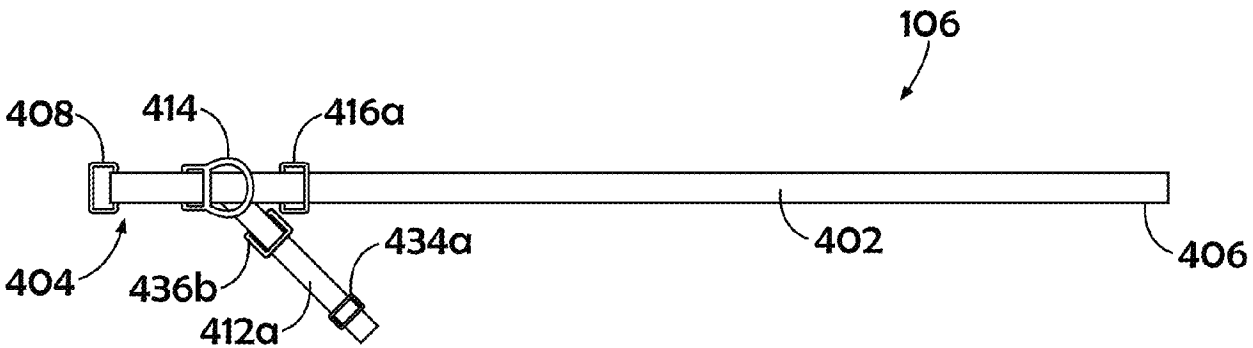
Figure 5:
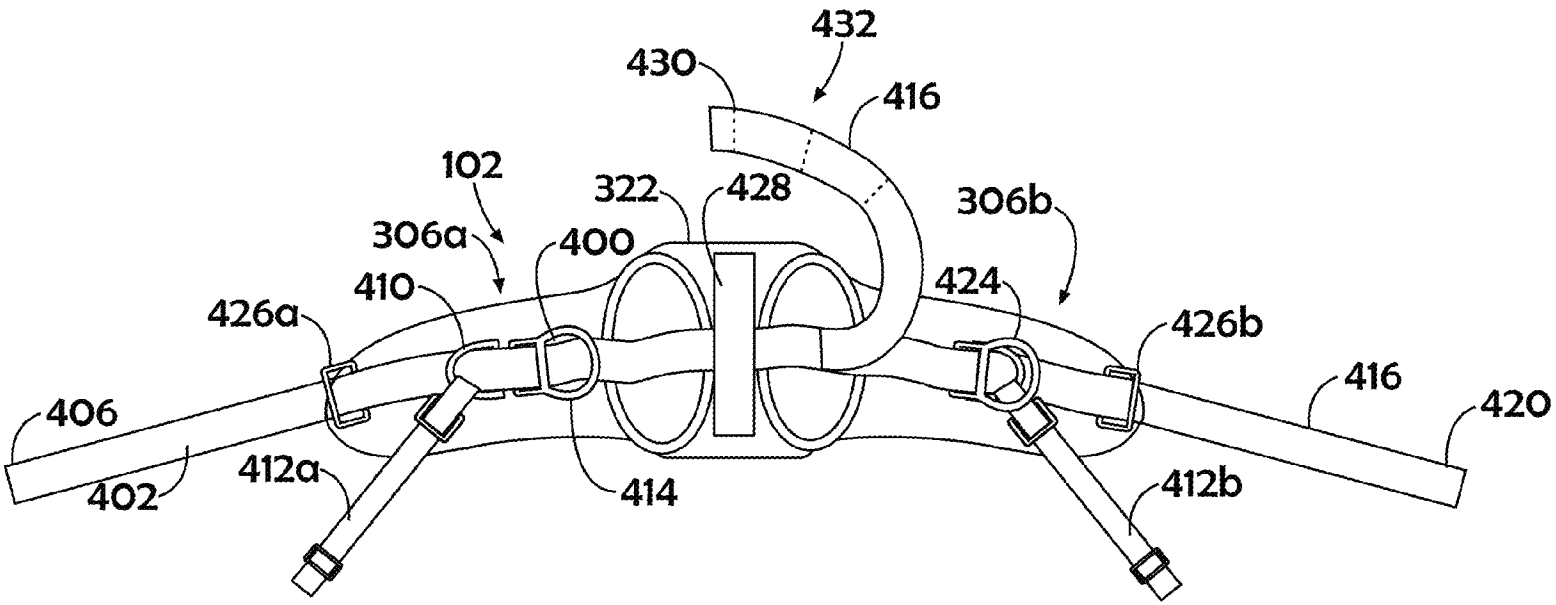
FIG. 5 is a top plan view of a D-piece assembly attached to a back pad.

Referring now also to FIGS. 4*a* and 4*b*, there are shown detailed top plan views of long D-piece assembly 104 and short D-piece assembly 106, respectively, used to form a D-piece assembly 400 (FIG. 5).

Short D-piece assembly 106 has elongated webbing 402 having a proximal end 404 and a distal end 406. An adjustment buckle 426*a* is attached to webbing 402 approximately two-thirds the distance between distal end 406 and proximal end 404 of webbing 402.

A first D-ring 410 is attached to webbing 402 adjacent adjustment buckle 416*a* on the side of webbing 402 towards proximal end 408. A suspension assembly 412*a* is attached to first D-ring 410. Suspension assembles 412*a*, 412*b* each have an adjustment buckle suspension assembly 412*a* is discussed in detail hereinbelow.

A second D-ring 414 is attached to webbing 402 adjacent first D-ring 410 towards proximal end 408.

A slide bar friction buckle (e.g., a Y/2 buckle) 408 is attached to webbing 402 at proximal end 404.

Long D-piece assembly 104 has elongated webbing 416 having a proximal end 418 and a distal end 420. An adjustment buckle 426*b* is attached to webbing 416 at a point approximately two-thirds the distance from distal end 420 and proximal end 418 of webbing 416.

A first D-ring 422 is attached to webbing 416 adjacent adjustment buckle 426*b* towards proximal end 418. A suspension assembly 412*b* is attached to first D-ring 422. Suspension assembly 160*a* is discussed in detail hereinbelow.

A second D-ring 424 is attached to webbing 416 adjacent first D-ring 422 towards proximal end 418.

Referring again also to FIG. 3*a* and to FIG. 5, a D-piece assembly 400 is formed and assembled to back pad 102 by first threading distal end 406 of webbing 402 through webbing loop 330*a* on angled wing 306*a*. Distal end 406 then projects beyond an outer edge of the angled wing 306*a*.

Next, proximal end 418 of webbing 416 is fed outwardly through webbing loop 330*b* on an outer edge of angled wing 306*b*. Proximal end 418 then projects beyond an outer edge of angled wing 306*b*. Webbing 416 is fed, distal end 420 first, entirely through a bottom side, not specifically identified, of friction buckle 408. Once webbing 416 is pulled entirely through the bottom side of buckle 408, distal end 420 of webbing 416 is fed back through a top side, not specifically identified, of friction buckle 408. Distal end 420 is then fed through slot 428 of tailpiece 332, thereby securing short D-piece assembly 106 to long D-piece assembly 104 and forming D-piece assembly 400.

Excess 432 of webbing 416 remaining at proximal end 418 may be trimmed to a suitable length, if required. Webbing 416 has periodic cross stitching 430 to facilitate trimming to length. The webbing 416 may be cut adjacent an appropriate one of cross stitching 430 and then the exposed end of the remaining webbing 116 burned or otherwise sealed to prevent unraveling. Typically, a heat gun, lighter, propane torch, or electrically heated blade, none of which are shown, may be used for sealing the ends of cut webbing 416. Such end treatment techniques are known to those of skill in the art and are not further described herein.

While the D-piece assembly 400 has been described in conjunction with backpad 100, it will be recognized that the novel construction of D-piece assembly 400 may be used with and waist-encircling member equipped with necessary attachment points. Consequently, the invention is not considered limited to the combination of d-piece assembly and backpad 100. Rather, the invention covers D-piece assembly 400 inc combination with any waist-encircling member.

Referring again to FIG. 1, ergonomic saddle 100 has two leg strap assemblies 126 suspended from back pad 102.

Figure 6A:
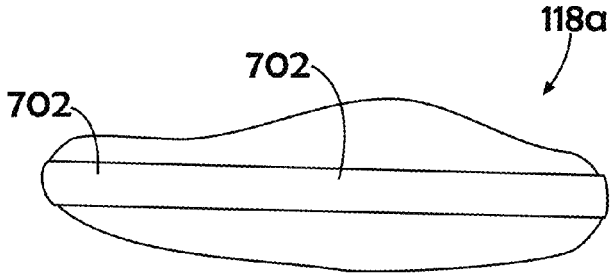
FIG. 6*a* is a top plan view of a leg pad prior to assembly.

Referring now to FIG. 6*a*, there is shown a top plan view of a leg pad 118*a* prior to its assembly into a leg pad assembly 126. Note that leg pad 118*b*, not shown in this FIGURE, is a mirror image of leg pad 118*a*. A web 702 is affixed to an outer surface (with respect to a wearer's leg) of leg pad 118*a* along a major axis thereof. The outer surface of web 702 has the hook portion of hook-and-loop fastening material 704 affixed thereto.

Figure 6B:
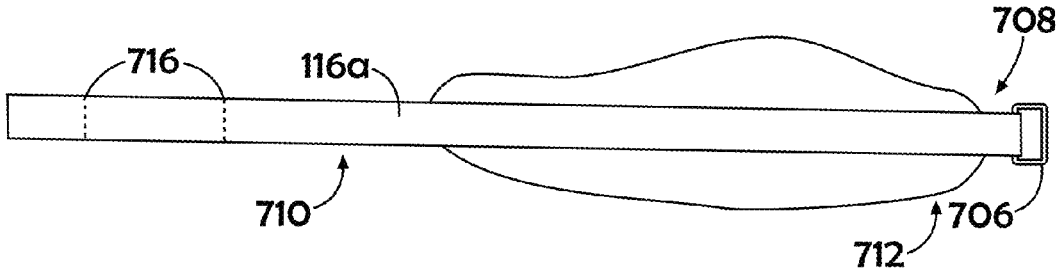
FIG. 6*b* is a top plan view of the leg pad of FIG. 7*a* with a leg strap assembled thereto.

Referring now also to FIG. 6*b*, there is shown a top plan view of the leg pad 118*a* of FIG. 6*a* with a leg strap 116*a* positioned on web 702. Leg strap 116*a* has the female portion, not specifically identified, of a quick-connect buckle 706 affixed to a proximal end 708 thereof. Loop portion 710 of hook-and-loop fastening material is affixed to an inner surface of leg strap 116*a*. The female portion of quick-connect buckle 706 is positioned adjacent an edge 712 of leg pad 118*a*. It will be recognized that the hook portion 704 and loop portion 710 of the hook-and-loop fastening system could readily be reversed.

Figure 6C:
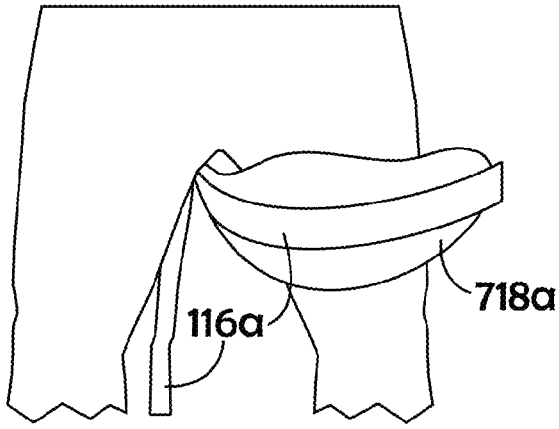
FIGS. 6*c* and 6*d* are front and rear elevational views, respectively, of the leg pad and leg strap of FIG. 6*b* in place on the leg of a wearer thereof.
Figure 6D:
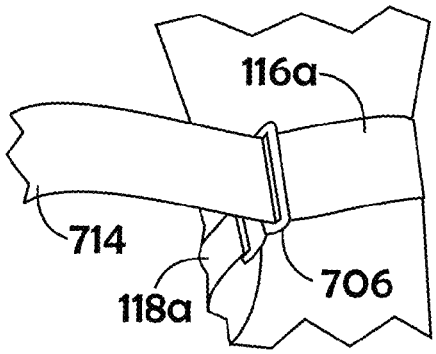

Prior to use, the length of leg strap 116*a* must be trimmed to size to accommodate the leg diameter of the wearer. As seen in FIGS. 6*c* and 6*d*, this may be done by donning leg pad 118*a* with the narrow side oriented towards the inside of the wearer's thigh and with the curved portion facing upwards towards the wearer's buttocks. It is assumed that a male portion, not specifically identified, of quick-connect buckle 706 has previously been inserted into and secured in the female portion thereof. The distal end 714 of leg strap 116*a* is then fed through the male portion of quick-connect buckle 706 and leg strap 116*a* is drawn snuggly around the wearer's leg, not specifically identified. Leg strap 116*a* may then be folded back over itself to engage mating hook-and-loop fastening material 704 on an outer surface of web 702.

Leg strap 116*a* is provided with periodic cross-stitching 716. Quick-connect buckle 706 may be opened and the excess portion of leg strap 116*a* trimmed by first cutting the strap adjacent one of the cross-stitching patterns 716 and then heat-sealing the remaining end. Heat sealing has been discussed hereinabove.

Figure 6E:
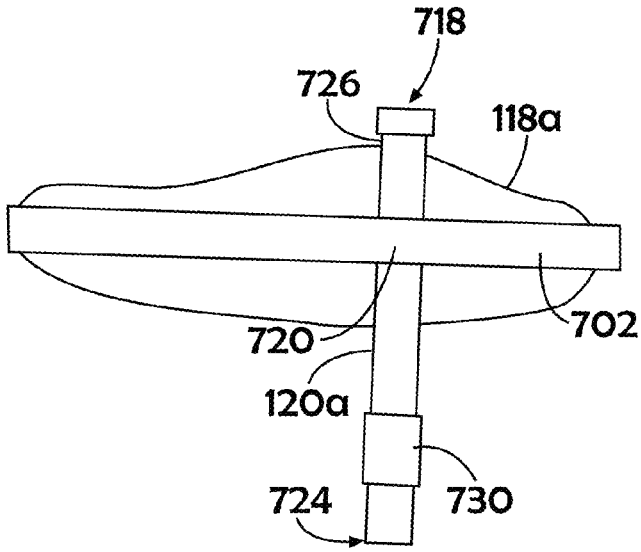
FIG. 6*e* is a top plan view of a leg pad and a leg strap retainer partially assembled.
Figure 6F:
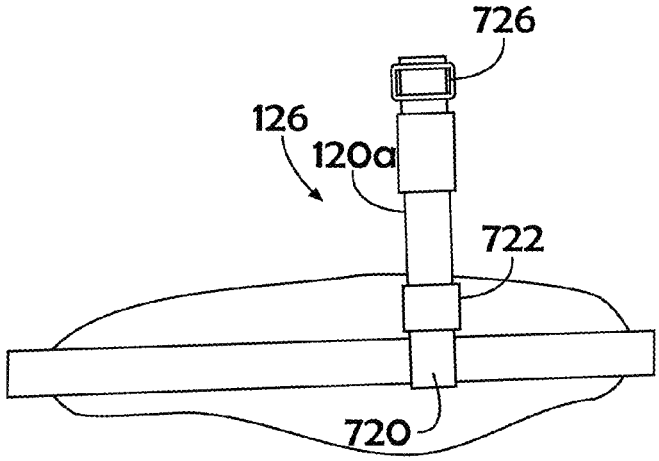
FIG. 6*f* is a top plan view of a leg pad and a leg strap retainer fully assembled.

As may be seen in FIG. 6*e*, leg strap retainer 120*a* has an adjusting buckle 726 adjacent proximal end 718 thereof. Adjusting buckle 726 of leg strap retainer 120*a* is fed through a loop 720 in web 702 on leg pad 118*a* and as may be seen in FIG. 6*f*, then fed back through a loop 720 attached to leg strap retainer 120*a* adjacent a distal end 724 thereof, thereby forming a girth hitch around web 702 through loop 720. Distal end 724 of leg strap retainer is now secured to web 702 of leg pad 118*a*.

An elastic web retainer 722 may be positioned over a free portion of leg strap retainer 120*a* to secure the free end created when adjusting buckle 726 is moved along leg strap retainer 120*a* away from proximal end 718. As assembled, leg pad 118*a*, leg strap 116*a* and leg strap retainer 120*a* make up leg pad assembly 126. A second leg pad assembly 126 (FIG. 1) is formed from leg pad 118*b*, leg strap 116*b*, and leg strap retainer 120*b*.

As is well known to those of skill in the art, hook-and-loop keeper retainers 730 may be inserted into friction buckles such as adjusting buckle 726, as required.

Figure 6G:
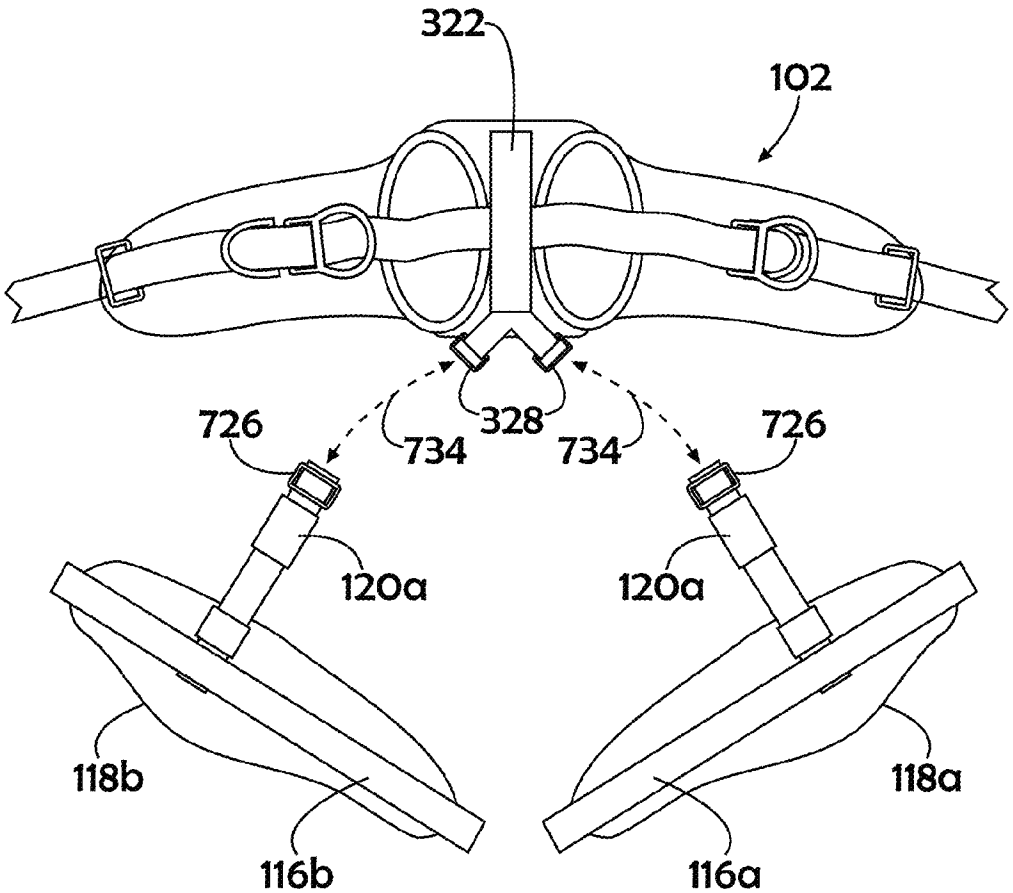
FIG. 6*g* is a top plan view of back pad assembly with a leg strap retaining anchor attached thereto and two leg pad assemblies.

Referring now to FIG. 6*g*, there is shown a top plan view of back pad assembly 102 having leg strap retaining anchor 122 attached thereto and two leg pad assemblies 126 disposed adjacent thereto. Leg strap retaining anchor 122, secured to back pad 102 through a loop in tailpiece 332, has a pair of buckles 328, each adapted to removably receive an adjusting buckle 726 from one of leg strap retainers 120*a*, 120*b* as indicated by dashed lines 734. Buckles 328 and adjusting buckles 726 together form interlocking buckles.

While a detailed description of the assembly of leg pad 118*a* into a leg pad assembly 126 has been provided, the description also applies to the assembly of leg pad 118*b* and its related components, leg strap 116*b* and leg strap retainer 120*b*.

Another unique feature of the sit harness or saddle 100 of the invention is the interchangeable suspension components. For purposes of disclosure, a suspension bridge assembly 114 (FIG. 2), useful for attachment in a dynamic climbing system. It will be recognized that other suspension systems (i.e., suspension bridge assemblies) adapted for different climbing systems and styles may readily be substituted therefor.

Figure 7:
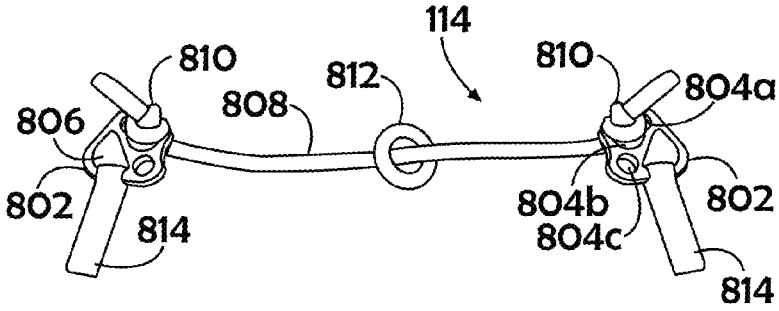
FIG. 7 is a top plan view of a suspension bridge assembly.

Referring again to FIG. 1, suspension bridge assembly 114 is seen attached to back pad 102 upper suspension assemblies 412*a*, 412*b*, and to leg pad assemblies 126. Referring now also to FIG. 7, there is shown a top plan view of suspension bridge assembly 114, which consists of a pair of rigging or climbing plates 802. Climbing plates 802 each have three circular openings 804*a*, 804*b*, 804*c* and a larger, substantially triangular opening 806 disposed in an interior portion thereof. A suspension bridge or line 808 is passed through one of the circular openings 804*a*, 804*b*, 804*c* in each of the two climbing plates 802. A stopper knot is tied at each end of suspension bridge. An attachment ring 812 is free to slide on cord 808 between climbing plates 802. Suspension loops 814 formed from webbing are attached to each of climbing plates 802 through substantially triangular opening 806.

Suspension bridge assembly 114 is attached to leg pad assemblies 126 by passing leg straps 116*a*, 116*b* (FIG. 6*g*) through respective suspension loops 814.

Once suspension bridge assembly 114 is attached to leg pad assemblies 126, suspension assemblies 412*a*, 412*b*, depending from back pad assembly 102, are attached to respective climbing plates 802 by disconnecting, if necessary, adjustment buckles 434*a* and/or 434*b* (FIGS. 4*a* and 4*b*) from suspension assembly support buckle frames 436*a*, 436*b* (FIGS. 4*a* and 4*b*), respectively. Adjustment buckles 434*a*, 434*b* may be used by a wearer of sit harness 100 to control his or her center of gravity. Distal ends 438*a*, 438*b* of respective suspension assemblies 412*a*, 412*b* are passed through triangular opening 806. Suspension assembly adjustment buckles 434*a*, 434*b* are then passed through and retained by suspension assembly support buckle frames 436*a*, 436*b*, respectively, thereby securing suspension bridge assembly 114 to back pad assembly 102.

Figure 8:
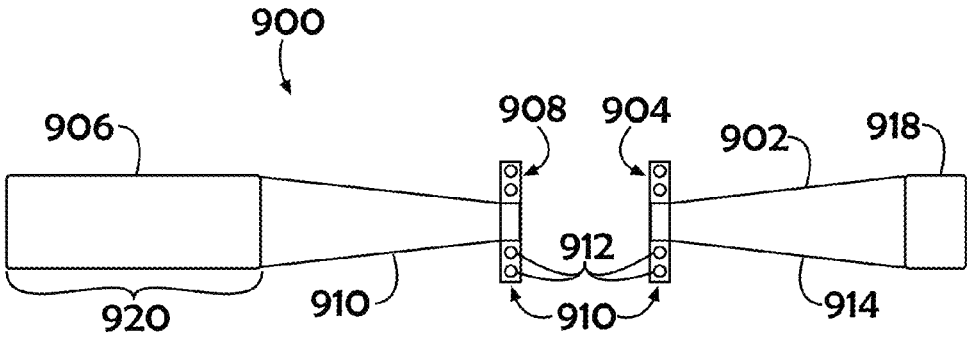
FIG. 8 is a top plan view of the components of an abdominal stabilizer system.

Referring now to FIGS. 9-8, there is shown a top plan view of the components of an abdominal stabilizer system, generally at reference number 900. Abdominal stabilizer system 900 may readily be attached to and removed from back pad 120 of the reconfigurable sit harness or saddle 100.

Abdominal stabilizer 900 has a short component 902 having a proximal end 904, and a long component 906 having a proximal end 908. Both short component 902 and long component 906 are formed from at least one elastic strap 914, 916, respectively, and each have short, snap-bearing web portions 910 affixed to elastic straps 914, 916 at respective proximal ends 904, 908 thereof. Snap-bearing web portions 910 each have pairs of snaps 912 affixed thereto.

Short component 902 has a hook portion 918 of a hook-and-loop fastening system on outer surfaces thereof. Correspondingly, long component 906 has a loop portion of a hook-and-loop fastening system disposed on an outer surface thereof. It will be recognized that hook portion 918 and loop portion 920 may, of course, be interchanged as desired.

Referring now also to FIGS. 3*a* and 3*b*, abdominal stabilizer 900 is attached to back pad 102 by inserting distal end 904 with snap-bearing web portion 910 of short component 902 through one of the slots 312 in back pad 102. Snap-bearing web portion 910 is looped around horizontal webbing 328 and secured using snaps 912.

Likewise, long component 906 is secured to back pad 102 by inserting distal end 908 with snap-bearing web portion 910 through the other one of the slots 312 in back pad 102. Snap-bearing web portion 910 is also looped around horizontal webbing 328 and secured using snaps 912.

Distal ends of each of short component 902 and long component 906 are inserted through respective abdominal stabilizer loops 314 on the inside surface 300 of back pad 102.

In use, a wearer wraps short component 902 and long component 906 around his or her abdomen and attaches the respective hook portions 918 to loop portions 920 to secure the ends of abdominal stabilizer in a desired position.

Figure 9A:
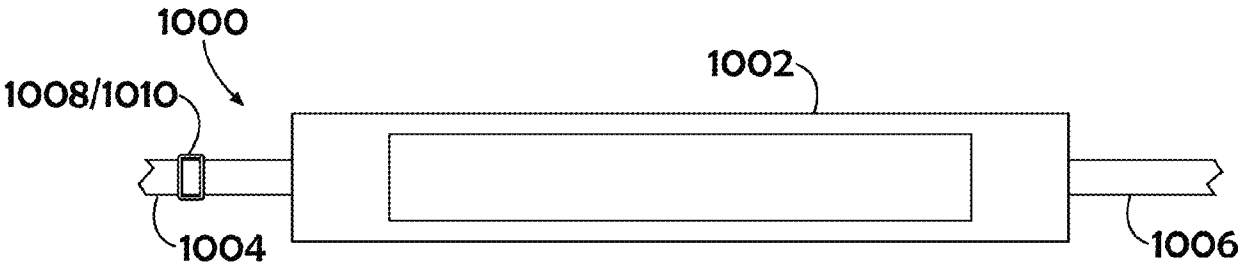
FIGS. 9*a* and 9*b* are top plan and bottom plan views, respectively, of a seat assembly for attachment to the sit harness assembly of FIG. 1.
Figure 9B:
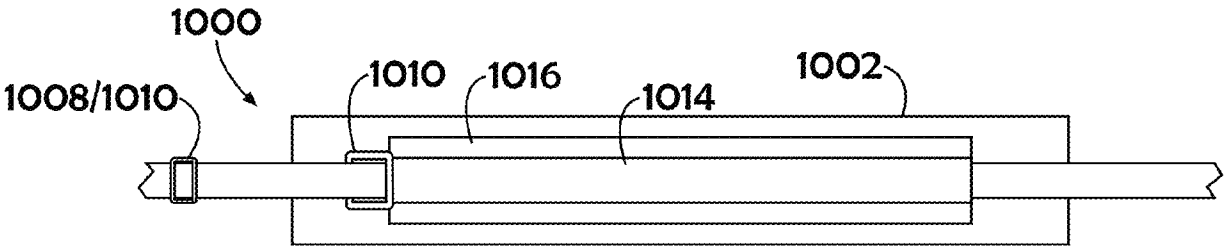

Another modular component of sit harness or saddle 100 is a suspended seat. Referring now to FIGS. 9*a* and 9*b*, there are shown top plan and bottom plan views, respectively, of a seat assembly adapted for selective use with sit harness or saddle 100 of the present invention, generally at reference number 1000. A body portion 1002 has right and left attachment webs 1004, 1006, respectively secured proximate the right and left ends thereof. Each attachment web 1004, 1006 has both halves 1008, 1010 of an interlocking buckle disposed thereupon.

A support web 1014 is attached to a bottom surface of body portion 1002 of seat 1000, right and left attachment webs 1004, 1006, respectively, being attached thereto.

A batten pocket 1016 is also disposed on a lower surface of seat 1000. A batten, not shown, formed from aluminum or another suitable material, is housed in batten pocket 1016. The batten may be permanently enclosed in batten pocket 1016 or, in alternate embodiments, may be selectively removable therefrom.

Figure 9C:
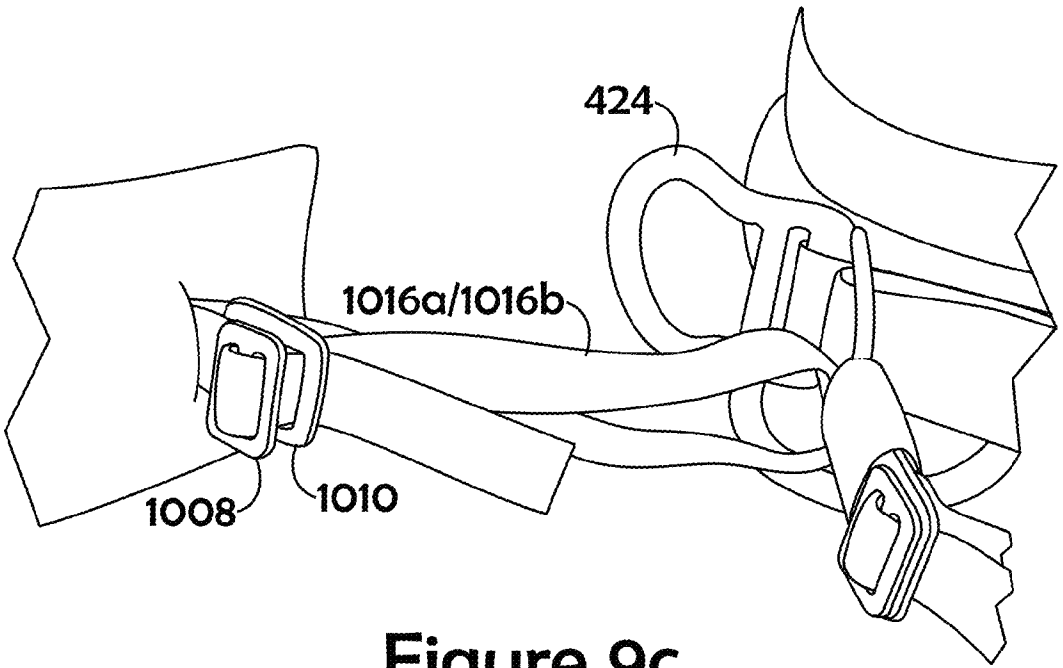
FIG. 9*c* is a detailed view showing attachment of a seat assembly to a back pad assembly.

Referring now also to FIG. 9*c*, seat 1000 is attached to suspensions assemblies 412*a*, 412*b* by passing a distal end of each of right and left attachment webs 1004, 1006, respectively, through first D-ring 422 (FIG. 5) on D-piece assembly 400 (FIG. 5). Small adjustment portion of the interlocking buckle 1008 is then secured in large portion 1010 of the interlocking buckle 1008. Once secured, the small, adjusting portion of the interlocking buckle 1008 may be used to adjust the height of the seat 1000 relative to back pad 102.

Figure 10A:
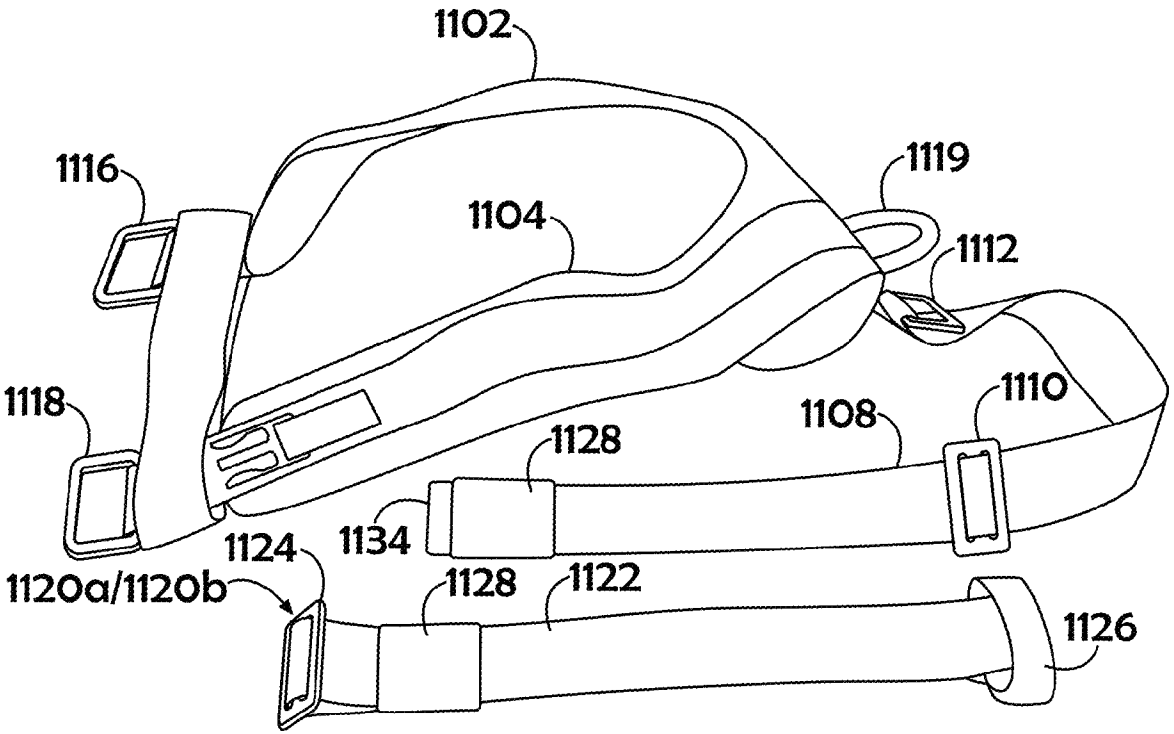
FIG. 10*a* is a top plan view of a body harness and body harness connecting straps.

Yet another modular component for use with sit harness or saddle 100 of the invention is a readily attachable full body harness to allow use of the novel sit harness 100 cooperatively with a fall arrest or restraint system, not shown. Referring now to FIG. 10*a*, there is shown a front elevational view of a full body harness 1100 configured for removable attachment to back pad assembly 102.

Right and left front straps 1102, 1104, respectively, converge at a point 1106 which, when in use, is positioned near the back of the wearer's shoulders. A back strap 1108 carries two halves of interlocking buckle 1008, small adjusting portion 1110 and large portion 1112.

A cross-connecting chest strap 1114 is disposed adjacent the lower ends of left and right front straps 1102, 1104, respectively.

Large portions 1116, 1118 of interconnecting buckles 1008 are attached at the lower ends of respective right and left front straps 1102 and 1104.

A suspension ring 1119 is attached to harness 1100 proximate point 1106.

A pair of identical harness connecting straps 1120*a*, 1120*b*, only one of which is shown, each has a web portion 1122 with a small, adjusting portion 1124 of an interlocking buckle

1008 disposed at a proximal end of web portion 1122. A web loop 1126 is affixed to web portion 1122 at a distal end thereof.

Elastic web retaining sleeves 1128 are disposed on both back attachment strap 1108 and web portion 1122 of each harness connecting strap 1120*a*, 1120*b*.

Figure 10B:
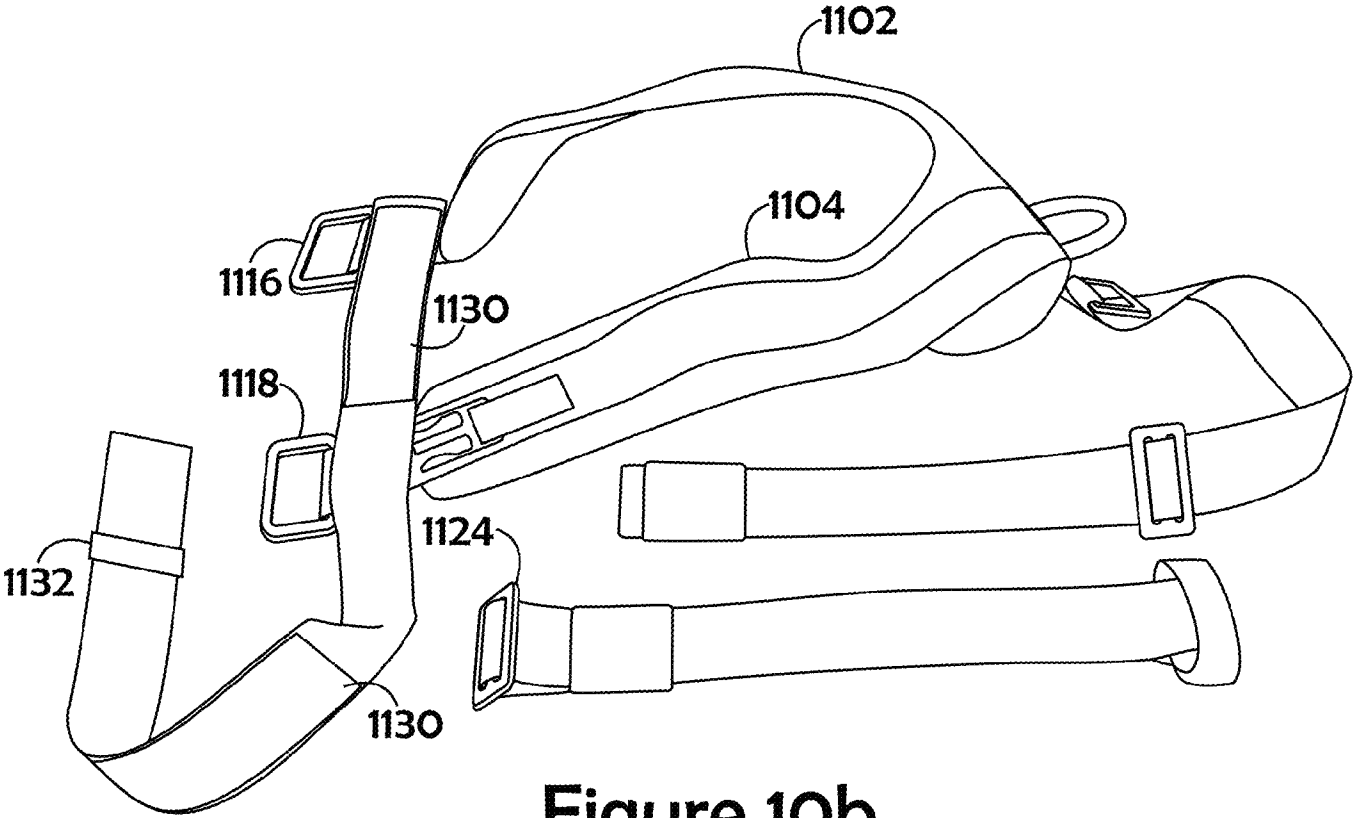
FIG. 10*b* is a top plan view of the body harness of FIG. 10*a* with a chest strap unfastened.

Referring now also to FIG. 10*b*, cross-connecting chest strap 1114 has hook-and-loop material 1130 disposed on inner and outer surfaces. Reference number 1130 is used to schematically represent either hook portions or loop portions of the hook-and-loop fastening material. Hook-and-loop material is disposed and configured to allow surfaces of cross-connecting chest strap to fasten to one another to provide length adjustability thereof.

A wrap length warning label 1132 affixed to cross-connecting chest strap 1114 is used as a visual indicator if to alert a wearer of an unsafe wrap length.

Body harness 1100 is connected to back pad assembly 102 by first passing buckles 1124 of harness connecting straps 1120*a*, 1120*b* through loops, not specifically identified, in webbing 328 (FIG. 5) proximate webbing loops 330*a*, 330*b* (FIG. 5). Girth hitches, not shown, are thereby formed as buckles 1124 of harness connecting strap 1120*a*, 1120*b*, fastened at respective ends of back pad 102 (FIG. 5).

The back of harness 1100 is next attached to back pad 102 by passing distal end 1134 of back attachment strap 1108 through buckle frame 356 (FIG. 3*b*). Alternately, distal end 1134 may be passed through a carabineer, not shown, attached to a loop, not shown, in tailpiece 332 (FIG. 3*b*).

Small adjusting portion 1110 of and interlocking buckle is then connected to large buckle portion 1112. The effective length of back attachment strap 1108 may be adjusted by means of small adjusting portion 1110.

Once back connecting strap 1108 is connected to back pad 102, left front strap 1102 and right front strap 1104 are placed over a wearer's respective shoulders, not shown and bottom connecting buckles 1116, 1118 are connected to respective buckles 1124 of harness connecting straps 1120*a*, 1120*b*. Buckles 1124 may then be used to adjust the effective lengths of harness connecting straps 1120*a*, 1120*b* to properly fit a wearer.

Many buckles and connectors have been shown in the embodiment of the novel sit harness or saddle chosen for purposes of disclosure. It will be recognized that numerous equivalent buckles and connectors may be known to persons of skill in the art. Consequently, the invention is not considered limited to the particular buckles and/or connectors chosen for purposes of disclosure. Rather, the invention includes any and all alternate buckles or connectors. and that substitutions of such equivalent buckles and/or connectors.

The foregoing illustrates the modular, reconfigurable construction of the sit harness or saddle 100 of the invention. The construction allows individual components to be replaced readily and relatively inexpensively in case of damage or severe wear. Consequently, unlike related safety equipment of the prior art, the cost of ownership of the sit harness 100 may be minimized. For example, the load bearing webbing is detachable from the back pad allowing selective replacement of either component as required. Spare components, not shown, may be stocked at a job site to minimize down time in the event of damage at the job. The novel sit harness or saddle 100 may be completely reconstructed in a matter of minutes.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A reconfigurable, modular, ergonomic sit harness or saddle, comprising:

a) an ergonomic back pad having a central lumbar portion and an angled wing portion proximate each side of said central lumbar portion;

b) a long D-piece assembly adjustably affixed to said back pad and comprising at least two long D-piece assembly work-positioning D-rings and an adjustment buckle, allowing said at least two long D-piece assembly work-positioning D-rings to be selectively, laterally positioned with respect to one another along a major axis of said back pad;

c) a short D-piece assembly adjustably affixed to said back pad and comprising at least two short D-piece assembly work-positioning D-rings and an adjustment buckle, allowing said at least two short D-piece assembly work-positioning D-rings to be selectively, laterally positioned with respect to one another along a major axis of said back pad;

d) an adjustable waist band having means for fastening affixed to at least one end thereof, operatively connected to at least one of said long D-piece assembly, said short D-piece assembly, said back pad, and said adjustable waist band, which, in cooperation with said long D-piece assembly and said short D-piece assembly, provides length adjustability at a predetermined ratio;

e) two leg pad assemblies adjustably suspended from at least one of said back pad, said long D-piece assembly, said short D-piece assembly, and said adjustable waist band; and f) an interchangeable suspension bridge assembly operatively connected to at least one of said long D-piece assembly, said short D-piece assembly, said adjustable waistband, and said back pad and at least one of said two leg pad assemblies.

2. The reconfigurable, modular, ergonomic sit harness or saddle as recited in claim 1, wherein said ergonomic back pad comprises a pocket disposed in said central, lumbar portion, said pocket having an interior portion substantially sealed along a lower edge thereof and adapted to removably receive at least one of the group: at least one interchangeable lumbar pad, a hot or cold pack, and another therapeutic object therein, said pocket having a closing flap disposed along an upper edge thereof to retain pocket contents therein.

3. The reconfigurable, modular, ergonomic sit harness or saddle as recited in claim 1, wherein said ergonomic back pad comprises a gender-specific back pad wherein at least said angled wing portions are contoured to conform to and protect the pelvis of a wearer.

4. The reconfigurable, modular, ergonomic sit harness or saddle as recited in claim 1, wherein said ergonomic back pad comprises at least one padding layer disposed in an interior region thereof substantially completely throughout the entire ergonomic back pad, and an additional thickness of padding disposed in an interior portion of said angled wing portions.

5. The reconfigurable, modular, ergonomic sit harness or saddle as recited in claim 4, wherein at least a thickness of said at least one padding layer is determined by a gender for which a particular ergonomic back pad is constructed.

6. The reconfigurable, modular, ergonomic sit harness or saddle as recited in claim 4, wherein said wing portions comprise a semi-rigid barrier disposed in an interior portion thereof.

7. The reconfigurable, modular, ergonomic sit harness or saddle as recited in claim 1, wherein at least one of said D-piece assembly, said waist band, said leg pad assemblies and said suspension bridge assembly comprise removable components, said removable components being individually replaceable.

8. The reconfigurable, modular, ergonomic sit harness or saddle as recited in claim 1, wherein said predetermined ratio is in the range of approximately 3:1.

9. The reconfigurable, modular, ergonomic sit harness or saddle as recited in claim 1, further comprising:

g) an abdominal support assembly removably attachable to said ergonomic back pad.

10. The reconfigurable, modular, ergonomic sit harness or saddle as recited in claim 1, further comprising:

g) a seat removably attachable to at least said ergonomic back pad.

11. The reconfigurable, modular, ergonomic sit harness or saddle as recited in claim 10, wherein said seat comprises a batten.

12. The reconfigurable, modular, ergonomic sit harness or saddle as recited in claim 11, wherein said batten comprises a batten selectively removable from said seat.

13. The reconfigurable, modular, ergonomic sit harness or saddle as recited in claim 1, further comprising:

g) a body harness removably attachable to at least said ergonomic back pad.

14. The reconfigurable, modular, ergonomic sit harness or saddle as recited in claim 1, further comprising a full body harness connected to said back pad assembly, said full body harness comprising at least one attachment point for a fall arrest device.

15. The reconfigurable, modular, ergonomic sit harness or saddle as recited in claim 1, wherein load bearing webbing is separable from said back pad assembly to allow selective, independent replacement of either one of said back pad assembly and said load bearing webbing.

* * * * *